United States Patent [19]

House

[11] Patent Number: 4,497,981

[45] Date of Patent: Feb. 5, 1985

[54] MULTI-DRIVER LOUDSPEAKER

[75] Inventor: William N. House, Bloomington, Ind.

[73] Assignee: Harman International Industries Incorporated, Northridge, Calif.

[21] Appl. No.: 383,603

[22] Filed: Jun. 1, 1982

[51] Int. Cl.[3] ..... H04R 1/24; H04R 9/06; H04R 17/00

[52] U.S. Cl. ..... 179/115.5 PS; 179/110 A; 179/116; 181/144; 181/163

[58] Field of Search ..... 181/144, 163, 147; 179/115.5 PS, 116, 110 A, 115.5 R, 115 R

[56] References Cited

U.S. PATENT DOCUMENTS

| | | | |
|---|---|---|---|
| 2,053,364 | 9/1936 | Engholm | 179/110 A |
| 2,231,479 | 2/1941 | Perry | 179/115.5 |
| 2,259,907 | 10/1941 | Olney | 179/115.5 R |
| 2,269,284 | 1/1942 | Olson | 179/115.5 |
| 2,539,672 | 1/1951 | Olson et al. | 181/144 |
| 3,158,697 | 11/1964 | Gorike | 179/116 |
| 3,796,839 | 3/1974 | Torn | 179/116 |
| 4,146,110 | 3/1979 | Maloney et al. | 181/147 |
| 4,246,447 | 1/1981 | Vorie | 179/110 A |
| 4,418,248 | 11/1983 | Mathis | 179/115.5 PS |
| 4,447,678 | 5/1984 | Fidi | 179/116 |

FOREIGN PATENT DOCUMENTS

| | | | |
|---|---|---|---|
| 830351 | 11/1957 | United Kingdom | 179/115.5 PS |
| 857413 | 12/1960 | United Kingdom . | |

OTHER PUBLICATIONS

Harry F. Olson, *Elements of Acoustical Engineering* RCA Labs., Princeton, N.J., 1947, p. 224.

*Primary Examiner*—Gene Z. Rubinson
*Assistant Examiner*—Danita R. Byrd
*Attorney, Agent, or Firm*—Barnes & Thornburg

[57] ABSTRACT

A multi-driver loudspeaker assembly having high and low frequency transducers in which the high frequency transducer(s) is directly coupled to the diaphragm of the low frequently transducer and is movable therewith.

12 Claims, 1 Drawing Figure

MULTI-DRIVER LOUDSPEAKER

BACKGROUND OF THE INVENTION

This invention relates generally to loudspeaker systems and more particularly to systems in which the audio frequency signal is divided into upper and lower ranges for higher fidelity reproduction from transducers particularly designed for that purpose. It is well known that the size, configuration and even the operating principles of high frequency acoustic transducers may differ substantially from those of low frequency transducers. Separate and independently operable transducers have been available for a long time, which can faithfully reproduce sound within given frequency bands. Efforts to reproduce high fidelity sound for the human ear have targeted questions such as where the frequency division should be made, how a transducer should function within its assigned frequency range, how many frequency divisions and transducers should be used, how the transducers should be physically arranged and associated with one another, and perhaps many other considerations of both broad and narrow scope.

It has been a practice for some time to provide speaker systems wherein the audio signal is divided into upper and lower frequencies and distributed to transducers particularly designed to best reproduce low or high frequency sound. It has also been common, for various reasons, to construct within a single assembly a combination of two or more transducers in which the high frequency transducer is co-axially mounted with respect to the low frequency transducer. The reasons and advantages of such co-axial relationship are well known and need no explanation here.

Co-axial loudspeakers have, in the past, employed entirely independent transducers, their interrelationship being almost entirely a matter of mechanical placement with some regard for the acoustical effects which result therefrom. Typically, "co-axial" speaker systems employ one or more high frequency drivers mounted above the lower frequency systems by a post or bridge-like support and have independent electrical connections; and as a result said drivers often have irregular frequency response characteristics due to phase cancellation between the drivers and deffraction effects caused by the support apparatus.

PRIOR ART

Typical of the above features of the prior art, but by no means all inclusive, are U.S. Pat. Nos. 4,146,110 (Maloney); 3,796,839 (Torn); 3,158,697 (Gorike); and 2,259,907 (Olney). These patents all incorporate to varying degrees the features mentioned above.

It is also well known that in acoustic transducers, there are at least two types of drive mechanisms: the moving coil and the piezo-electric types. U.S. Pat. No. 4,246,447 (Vorie) is an example of the piezo-electric mechanism.

SUMMARY OF THE INVENTION

The speaker system of the present invention comprises a low frequency dynamic radiator type transducer or woofer and one or more upper frequency transducer(s) or tweeter(s) mounted in a single assembly, but not requiring the elaborate and costly mounting techniques of the prior art devices. The woofer unit typically is of the permanent magnet, moving coil configuration, its dynamic radiator being a diaphragm. The tweeter is mounted in the space defined by the aforesaid diaphragm, and consists essentially of a smaller diameter diaphragm having situated at its apex a driver mechanism comprising a piezo-electric element.

In this configuration, the entire mechanism which constitutes the tweeter moves in unison with the low frequency diaphragm in the piston range and forms a part of the total moving mass of the low frequency driver. This configuration eliminates the customarily used mounting post or brackets which support the high frequency unit(s) and also improves the overall frequency response, dispersion and time and phase characteristics of the loudspeaker system.

Accordingly, it is an object of the present invention to provide an improved multi-driver loudspeaker construction having improved overall frequency response, dispersion and improved time and phase characteristics.

It is also an object of the present invention to provide an improved multi-driver loudspeaker construction which eliminates the need for a separate mounting apparatus for the mid or upper frequency driving units.

DESCRIPTION OF THE DRAWING

These and other objects and advantages of the present invention will be more readily apparent to those skilled in the art upon reading the following detailed description in conjunction with the accompanying drawing in which.

DETAILED DESCRIPTION

Figure 1:
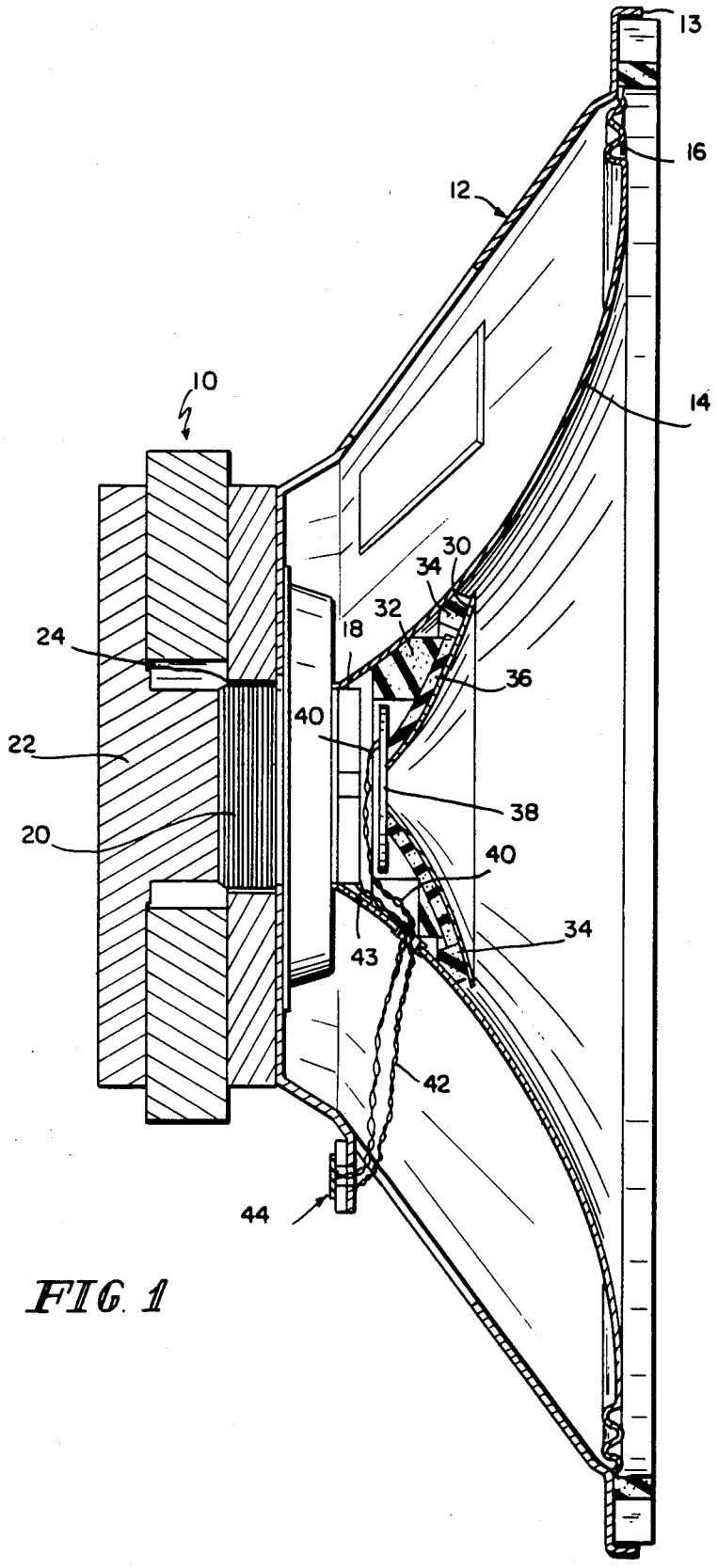
FIG. 1 is a cross-sectional view of the multidriver loudspeaker system made in accordance with the present invention.

In a preferred embodiment, the low frequency transducer or woofer is of the permanent magnet moving coil type and consists of the permanent magnet assembly 10 to which is secured a frame 12 having a generally circular conical configuration. Of course, the shape of the aperture 13 formed by the frame could be other than circular, for example, oval. The woofer diaphragm 14 extends or flares generally conically outwardly and has the ends secured to the periphery of the frame 12 by means of a compliant suspension 16. The inward portion of the diaphragm 14 is secured to the voice coil form 18 upon the lower portion of which is the voice coil 20 which surrounds the center pole 22 of the permanent magnet assembly 10 with the voice coil positioned in the magnetic air gap 24 in the customary fashion. Up to this point in the description, the construction of the transducer is entirely conventional.

The high frequency transducer or tweeter construction comprises the tweeter zone 30, the central axis, which is typically aligned with the central axis of the woofer cone 14. As shown in the drawing, the tweeter cone has a somewhat greater flare rate and is of substantially smaller dimension than the woofer cone 14. At the outer periphery of cone 30, a foam compliance ring 34 is positioned between the edge of cone 30 and the surface of diaphragm 14. Behind the diaphragm 30 and extending along a portion of the surface thereof, dampening or stiffening material 32 or 36 may be provided to smooth response and isolate the lead wires if desired. At the apex of cone 30, the driver element is positioned. This driver element consists of a piezo-electric crystal 38 in the form of what is commonly known in the trade as a bi-morph. The electrical leads 40 are connected to the crystal, 38, and extend out to the input terminals 44 mounted upon a portion of the frame 12. The leads 40 coming from the crystal 38 join leads 42 which connect to the input terminals 44 and likewise are connected to leads 43 which connect the voice coil 20 to leads 42.

The connection of the single pair of input leads to both drivers 38 and 20 without utilization of a divider or a crossover network is made possible because the crystal driver functions in the manner of a high pass filter network, and depending upon the thickness and diameter of the crystal and the diameter of cone 30 and its shape, etc., provides an effective crossover frequency in the range anywhere from one to ten kilohertz.

The provision of the fiberglass damping rings 32 and 36 are to suppress undesired vibrational modes while the foam compliance ring 34 provides a means to control and minimize phase interference in the acoustic radiation from both cones in the crossover region of response. A desirable acoustic response can thus be achieved by appropriate selection of the mass, the dimensions, the symmetry and the position of the tweeter mechanism as well as variations in the de-coupling ring 34 or damping ring 32 and 36. When operating in response to low frequency electrical signals, the transducer assembly appears much as if it were a single cone, the operations in response to high frequency signals above the crossover frequency adds to the translational motion of the high frequency cone 30 essentially as if it were acting alone except that it is mounted upon a moving platform in effect. This mounting arrangement between the diaphragms leads to improved frequency response and dispersion for the overall system and to improved time phase coherence throughout the desired frequency range. From a mechanical point of view, the arrangement of the present invention also eliminates the need for the supplemental mounting brackets customarily usedd in other co-axial systems to support the higher frequency drivers.

It will be obvious to those persons particularly skilled in this art that further changes or modifications of the design and configuration of this invention, as well as variation of the various factors mentioned herein, may be employed without departing from the scope and spirit of this invention as defined in the accompanying claims.

I claim:

1. A multi-driver loudspeaker combination comprising: a first transducer of the dynamic radiator type designed to reproduce sound in the lower portion of the audio frequency range, said radiator including a diaphragm; a piezoelectric transducer designed to reproduce sound in the upper portion of the audio frequency range, intermediate mounting means mounted on the diaphragm for supporting the piezoelectric transducer, said piezoelectric transducer being positioned within the periphery of the said diaphragm, said piezoelectric transducer being mounted through the intermediate mounting means upon said diaphragm and freely movable therewith in an unrestrained manner.

2. The loudspeaker combination of claim 1 wherein said first transducer includes driving means of the moving coil, permanent magnet type.

3. The loudspeaker combination of claim 2 wherein said intermediate mounting means comprises a compliance ring, means for mounting the compliance ring from the interior of the diaphragm and means for mounting the piezoelectric transducer from the compliance ring.

4. A multi-driver loudspeaker comprising a first transducer having a driver and a first diaphragm for reproducing sound in the lower portion of the audio frequency range, a second transducer having a piezoelectric driver and a second diaphragm for reproducing sound in the upper portion of the audio frequency range, and intermediate mounting means mounted on the first diaphragm for supporting the second transducer, the second diaphragm being mounted upon the first diaphragm through the intermediate mounting means for coupling the second diaphragm to the first diaphragm within the perimeter of the first diaphragm whereby the second transducer is supported by the first diaphragm and is freely movable therewith in an unrestrained manner.

5. In a multi-driver loudspeaker combination comprising a first transducer of the dynamic radiator type designed to reproduce sound in the lower portion of the audio frequency range, a second transducer designed to reproduce sound in the upper portion of the audio frequency range, said second transducer including a second transducer diaphragm and a piezoelectric driver, and means for mounting the second transducer from the first transducer consisting essentially of intermediate mounting means mounted on the diaphragm for supporting the second transducer for mounting the second transducer diaphragm through the intermediate mounting means from the first transducer.

6. The loudspeaker of claim 5 wherein the first transducer comprises a first transducer diaphragm and a first transducer driver.

7. The loudspeaker of claim 5 wherein the first transducer comprises a first transducer diaphragm and a first transducer driver and the intermediate mounting means comprises a compliance ring, means for coupling the compliance ring to the first transducer diaphragm and means for coupling the second transducer diaphragm to the compliance ring.

8. The loudspeaker of claim 7 wherein the first transducer diaphragm comprises an apex, a perimeter, an interior and an exterior and the second transducer diaphragm includes a perimeter, and the means for coupling the second transducer to the compliance ring comprises means for coupling the perimeter of the second transducer diaphragm to the compliance ring and the means for coupling the compliance ring to the first transducer comprises means for coupling the compliance ring to the interior of the first transducer diaphragm between the apex and perimeter of the first transducer diaphragm.

9. In a multi-driver loudspeaker combination comprising a first transducer of the dynamic radiator type designed to reproduce sound in the lower portion of the audio frequency range, a second transducer designed to reproduce sound in the upper portion of the audio frequency range, said second transducer including a second transducer diaphragm and a piezoelectric driver, and means for mounting the second transducer from the first transducer comprising intermediate mounting means mounted on the first transducer for mounting the second transducer diaphragm from the first transducer for free movement therewith in an unrestrained manner.

10. The loudspeaker of claim 9 wherein the first transducer comprises a first transducer diaphragm and a first transducer driver.

11. The loudspeaker of claim 9 wherein the first transducer comprises a first transducer diaphragm and a first transducer driver and the intermediate mounting means comprises a compliance ring, means for mounting the second transducer diaphragm from the compliance ring, and means for mounting the compliance ring from the first transducer diaphragm.

12. The loudspeaker of claim 11 wherein the first transducer diaphragm comprises an apex, a perimeter, an interior, and an exterior, and the second transducer diaphragm includes a perimeter, and the means for coupling the second transducer diaphragm to the compliance ring comprises means for coupling the perimeter of the second transducer diaphragm to the compliance ring and the means for coupling the compliance ring to the first transducer comprises means for coupling the compliance ring to the interior of the first transducer diaphragm between the apex and perimeter of the first transducer diaphragm.

* * * * *